US006313804B1

(12) United States Patent
Falk

(10) Patent No.: US 6,313,804 B1
(45) Date of Patent: Nov. 6, 2001

(54) CONTINUOUS APERTURE SCANNING ANTENNA

(75) Inventor: Kent Olof Falk, Mölnlycke (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/454,237

(22) Filed: Dec. 2, 1999

(30) Foreign Application Priority Data

Dec. 3, 1998 (SE) ..... 9804197

(51) Int. Cl.[7] ..... H01Q 3/00

(52) U.S. Cl. ..... 343/757; 343/756; 343/787

(58) Field of Search ..... 343/753, 754, 343/755, 756, 757, 787, 785

(56) References Cited

U.S. PATENT DOCUMENTS

| | | | | |
|---|---|---|---|---|
| 4,323,901 | | 4/1982 | De Wames et al. | 343/754 |
| 4,344,077 | | 8/1982 | Chekroun et al. | 343/754 |
| 4,447,815 | | 5/1984 | Chekroun et al. | 343/754 |
| 4,706,094 | | 11/1987 | Kubick | 343/754 |
| 5,309,166 | * | 5/1994 | Collier et al. | 343/778 |
| 5,729,239 | * | 3/1998 | Rao | 343/753 |

FOREIGN PATENT DOCUMENTS

| | | |
|---|---|---|
| 0 432 034 A1 | 12/1990 | (EP) . |
| 0 435 739 A1 | 12/1990 | (EP) . |
| 0 595 726 A1 | 10/1993 | (EP) . |
| 2 661 043 A2 | 4/1990 | (FR) . |
| 2 280 988 A | 2/1995 | (GB) . |
| 2 302 212 A | 1/1997 | (GB) . |
| 59-40705 A | 3/1984 | (JP) . |
| 1-282902 A | 11/1989 | (JP) . |
| WO 84/01669 A1 | 4/1984 | (WO) . |
| WO 93/10571 A1 | 5/1993 | (WO) . |

OTHER PUBLICATIONS

PCT International–Type Search Report No. SE 98/01395 prepared in connection with SE 9804197–3 by the Swedish Patent Office and completed on Sep. 17, 1999.

Microwave Journal (Feb. 1981, pp. 45–53) "RADANT: New Method of Electronic Scanning" by Claude Chekroun, D. Herrick, Yves Michel, R. Pauchard and P. Vidal.

IEEE AES Systems Magazine (Jun. 1997) "Two Low–Cost Phased Arrays" by J.B.L. Rao, G. V. Trunk and D. P. Patel (6 pages).

* cited by examiner

*Primary Examiner*—Tan Ho
(74) *Attorney, Agent, or Firm*—Jenkens & Gilchrist, P.C.

(57) ABSTRACT

A method and a device are disclosed for the generation of a surface, the reflection phase gradient or transmission phase gradient of which will be varied by means of a controllable static electric field. The present solution takes into account, instead of mainly the transmissive properties, also the reflection properties of an arrangement comprising a ferroelectric material. Such a reflecting surface may contribute to an entire antenna aperture, a portion of an antenna aperture or an element in a conventional array aperture. In a general case N lobes and M nulls are to be controlled at the same time. In such case the surface will preferably be designed as a curved surface, for instance a rotation symmetric parabola, while in other cases the reflector element may be designed just as a plane mirror. An antenna comprising such a reflector element of ferroelectric material can also form a polarization twisting Cassegrain antenna with a flat or curved main reflector element. The reflector element in a typical embodiment consists of a plate (50) of a material presenting ferroelectric properties and provided on each side with grids (2, 3) of parallel conducting wires (24, 34) fed by means of two resistive wires (25, 35). By applying a controllable voltage across each of the resistive wires the lobe of the continuous aperture scanning reflector antenna can be controlled in the X-Z plane by a voltage $U_x$ and in the Y-Z plane by a voltage $U_y$.

21 Claims, 6 Drawing Sheets

CONTINUOUS APERTURE SCANNING ANTENNA

TECHNICAL FIELD

The present invention relates to a continuous aperture scanning antenna device, and more exactly to a method and a device providing control of the direction of a main lobe or lobes of a scanning antenna without mechanically moving the antenna.

BACKGROUND

Sometimes it is desirable to be able to quickly change radiation direction of an antenna. In other words the antenna lobe is to be quickly shifted or swept between different directions. The demand regarding time is often such that an arrangement for mechanical motions of the antenna is not feasible.

Today antenna arrays are used which contain elements in which a signal phase at each element may be individually set to achieve a control of the main direction of the antenna lobe. Another technique to achieve a control of a radiation lobe is to utilize what is normally referred to as an "optical phased array", which includes an adaptable lens which, for instance, is disclosed in a document U.S. Pat. No. 5,212,583. This document describes a device utilizing a single plate of a material presenting ferroelectric properties. The plate is provided with a ground-plane on one side and two orthogonal grids on the other side for radiation lobe control. Both the grids and the ground-plane are made in a transparent material, indium/tin oxide. However, this document only refers to optical systems and does not discuss whether this should work within the microwave range.

Two documents U.S. Pat. Nos. 4,706,094 and 4,636,799 both disclose a ferroelectric block between grids of parallel wires. According to the first document only controlling fields are used across the block, i.e. in the propagation direction of the wave. According to the other document the voltages at the wires are arranged such that the field may adopt arbitrary directions in the plane perpendicular to the wires. In the first document it is pointed out that the "normally" high conductive wires only transmits perpendicular, linear polarization but that they may be replaced by resistive wires being able to transmit also parallel polarization of acceptable loss.

WO,A1,93/10571 demonstrates a development of U.S. Pat. No. 4,636,799 where only fields perpendicular to the wires are used. Here only one layer of wires is needed and the ferroelectric material has been divided into a plurality of blocks such that the grid of wires can be disposed in the middle of the ferroelectric layer.

However it will be noted that, the documents cited above are addressing the use of highly conductive wires and a voltage gradient is then achieved by applying different voltages to the individual wires according to a given pattern. Furthermore the devices described are related to utilizing the ferroelectric material for "electro-optic lenses" which primarily directs the utilization to frequencies corresponding to electromagnetic radiation in the nanometer range.

Therefore there is still a demand for a method and a device, which will operate even at a much lower frequency range.

SUMMARY

The present invention discloses a method and a device for the generation of a surface, the reflection phase gradient or transmission phase gradient of which will be varied by means of a controllable static electric field. The present solution takes into account, instead of mainly the transmissive properties, also the reflection properties of an arrangement comprising a ferroelectric material. Such a reflecting surface may contribute to an entire antenna aperture, a portion of an antenna aperture or an element in a conventional array aperture. The division of the aperture will depend on how many degrees of freedom are desired to be able to be controlled simultaneously. In a general case N lobes and M nulls are to be controlled at the same time. In such a case the surface will preferably be designed as a curved surface, for instance a rotation symmetric parabola, while in other cases the reflector element may be designed just as a plane mirror.

A method according to the present invention is set forth by the attached independent claim 1 or independent claim 4 and by the dependent claims 2 to 3, and 5 to 8.

Similarly a continuous aperture scanning antenna device according to the method of the present invention is set forth by the attached independent claims 9 and 12 and further embodiments are defined in the dependent claims 10 to 11, and 13 to 17.

BRIEF DESCRIPTION OF THE DRAWINGS

The invention, together with further objects and advantages thereof, may best be understood by making reference to the following description taken together with the accompanying drawings, in which.

DETAILED DESCRIPTION

Example of Embodiments

In a material presenting ferroelectric properties the dielectric properties will change under the influence of an electric field. This will be further discussed below in connection to a description of lobe control. Such a change of the dielectric properties over the surface of a reflecting plate will be utilized for creating a controllable scanning aperture antenna device. The antenna aperture or a portion of an aperture may be built up by means of a reflector element having highly conductive galvanically isolated parallel metal wires (in a x direction). By coating the wires with such a material presenting ferroelectric properties a reflection phase gradient will be achieved across the surface if an electric field having a suitable gradient is applied over the plate presenting the ferroelectric properties.

Figure 1:
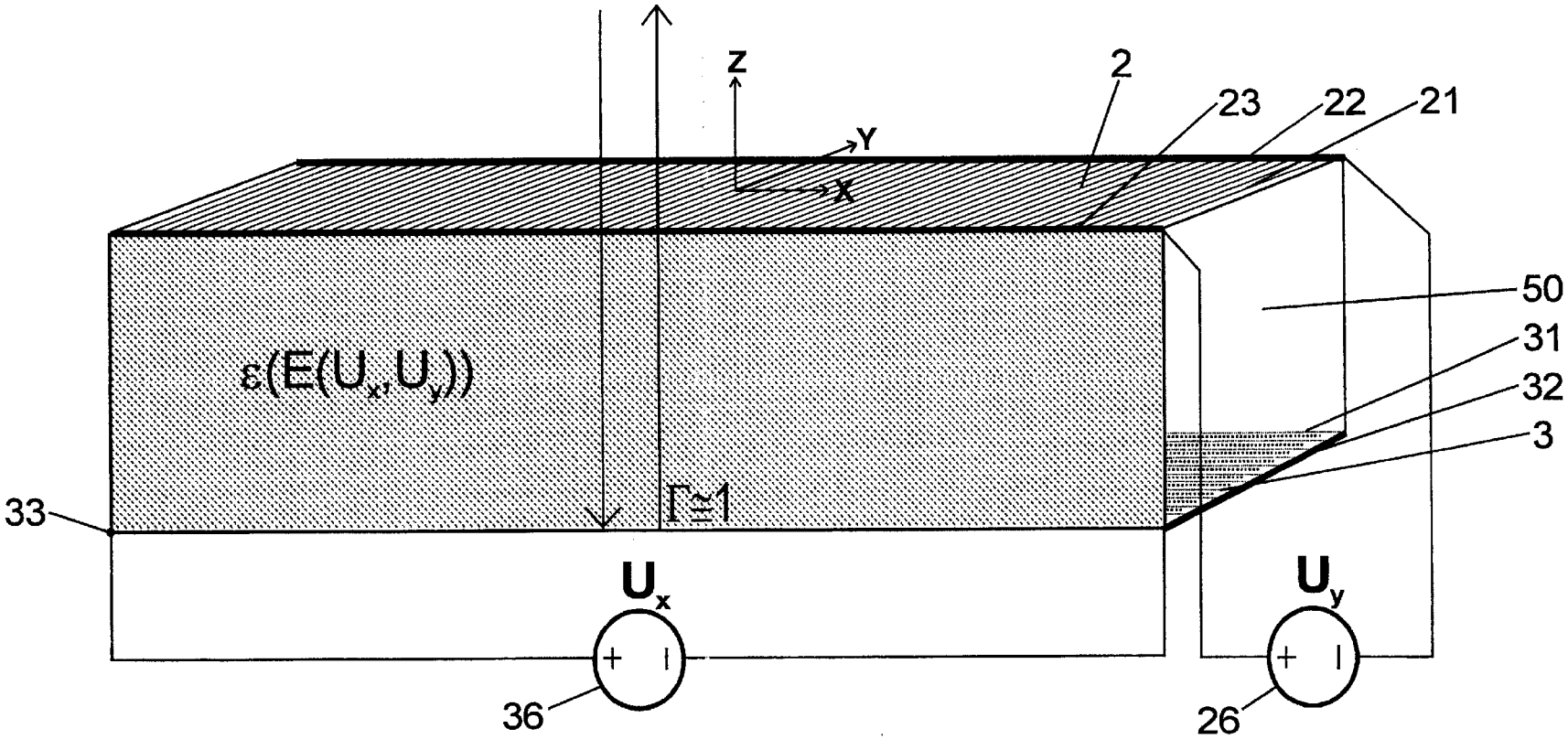
FIG. 1 is a sketch illustrating the principle according to a first embodiment of the present invention.
Figure 2:
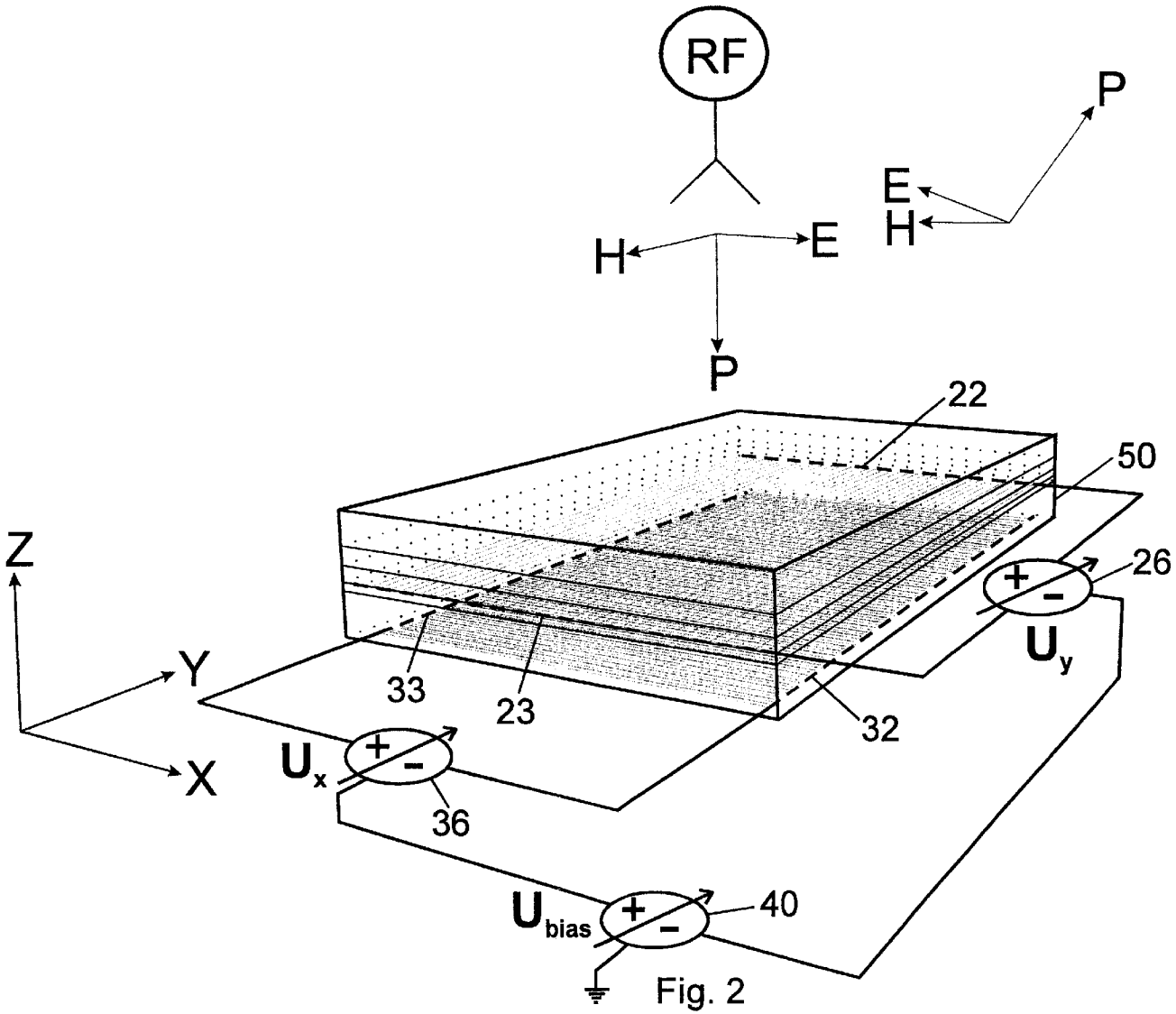
FIG. 2 illustrates a reflector element according to FIG. 1.

The electric field will be achieved by using two layers of parallel resistive wires, which are positioned perpendicular (orthogonal) to each other (see FIG. 1). One layer of wires 21 is positioned at a first side of a plate 50 of material presenting the ferroelectric properties forming a first grid 2 and another layer of wires 31 is positioned at the second side of the plate material forming a second grid 3. The wires 31 are positioned at the same side as a reflecting metallic grid of highly conductive wires positioned at the lower side of the plate 50 (not illustrated in FIG. 1), and the wires 31 are running parallel (in the x direction) to this highly conducting reflecting grid. The upper surface of the plate is illuminated with a linearly polarized field, the E vector of which being perpendicular to the metallic wires 21 ($E_y=E_z=0$). Thus, the illumination takes place from the side lacking the metal wires (the upper side). The ends of the resistive wires 31 at the lower side are all electrically connected in parallel by means of a metallic wire 32 at one end and a metallic wire 33 at the other end. A first variable voltage source ($U_x$) is connected to the wire 32 and the wire 33 and consequently across the second grid 3 of parallel resistive wires 31. Similarly the ends of the resistive wires 21 at the upper side of the plate 50 are connected in parallel by means of a metallic wire 22 at one end and a metallic wire 23 at the other end. A second variable voltage source ($U_y$) is connected to the wire 22 and wire 23 and consequently across the first grid 2 of parallel resistive wires 21. Now, as is demonstrated in FIG. 2, the lobe of the continuous aperture scanning reflector antenna can be controlled in the X-Z plane by $U_x$ and in the Y-Z plane by $U_y$. In FIG. 2 E represents the electric field vector and H the magnetic field vector of the propagating wave from the RF source. P represents the propagation vector (or Poynting vector). Notice that the electric field vector E will change its direction by 180 degrees at the reflection point.

Figure 3:
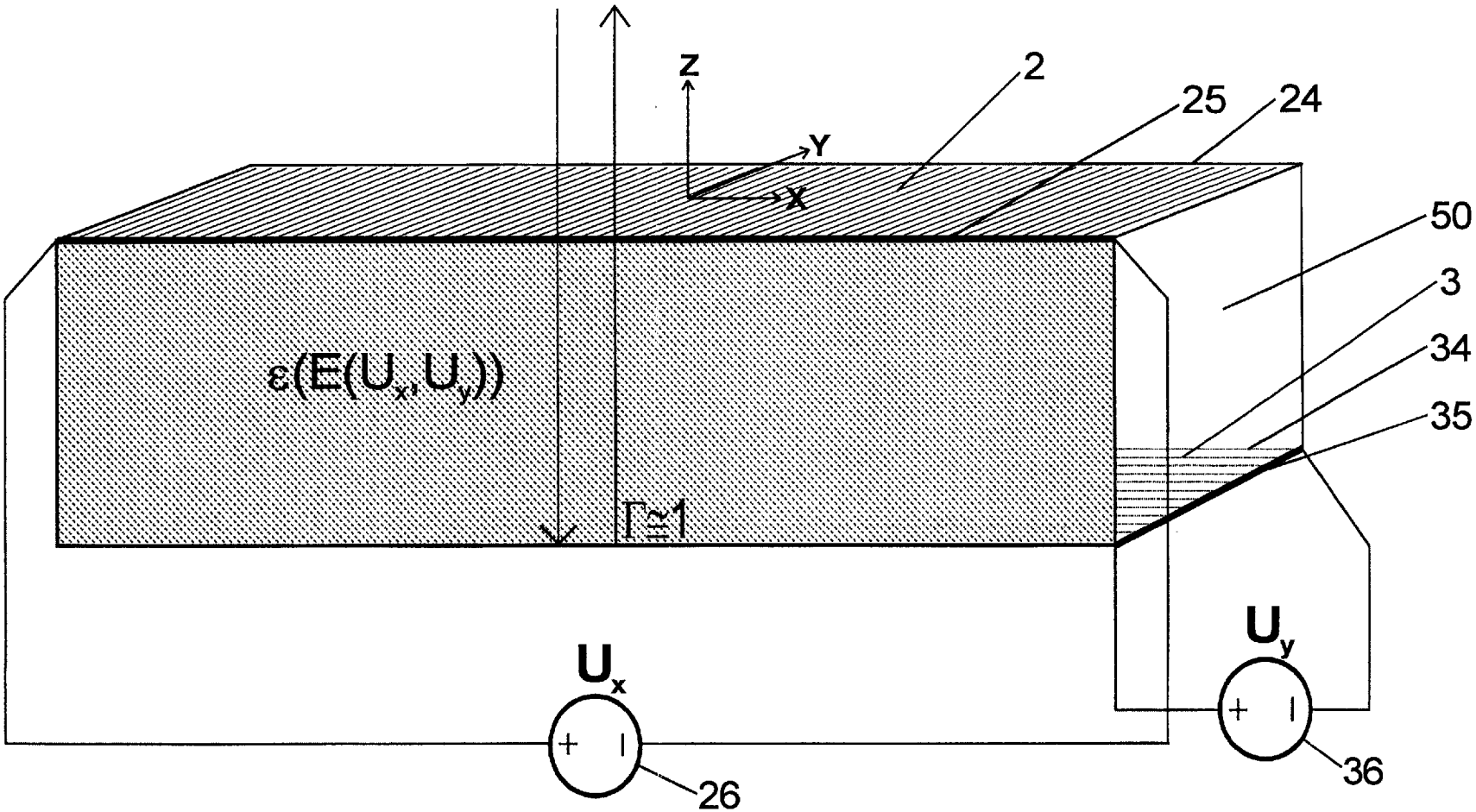
FIG. 3 is a sketch of the principle according to a second embodiment of the present invention.

According to FIG. 3 an alternative method to achieve an electric field strength having a suitable gradient is to replace the resistive wires 21 and 31 by highly conductive wires 24 and 34 at the respective sides of the material 50 presenting the ferroelectric properties. At one side of the grid of highly conductive wires 24 a resistive wire 25 is applied perpendicular to these wires at the ends of the wires 24 such that electrical contact is obtained. In this embodiment the other ends of the parallel wires 24 of highly conductive material are left open. A voltage source 26 ($U_x$) is connected across the resistive wire 25 at the upper side of the plate presenting the ferroelectric properties. At one side of the grid of highly conductive wires 34 a resistive wire 35 is applied perpendicular to these wires at the ends of the wires 34 such that electrical contact is obtained. Similar to the upper grid 2 the other ends of the parallel wires 34 of highly conductive material are left open. A voltage source 36 ($U_y$) is connected across the resistive wire 35 at the lower side of the plate presenting the ferroelectric properties. The advantage of this method is that it results in lower energy consumption using only one resistive wire 25 and 35 for the respective grids, and that the lower grid 3 of wires 34 also can act as a reflector. Thus, the extra grid of highly conductive metal wires of the first embodiment in FIGS. 1 and 2, described in the first paragraph of this section, can be omitted.

Figure 4:
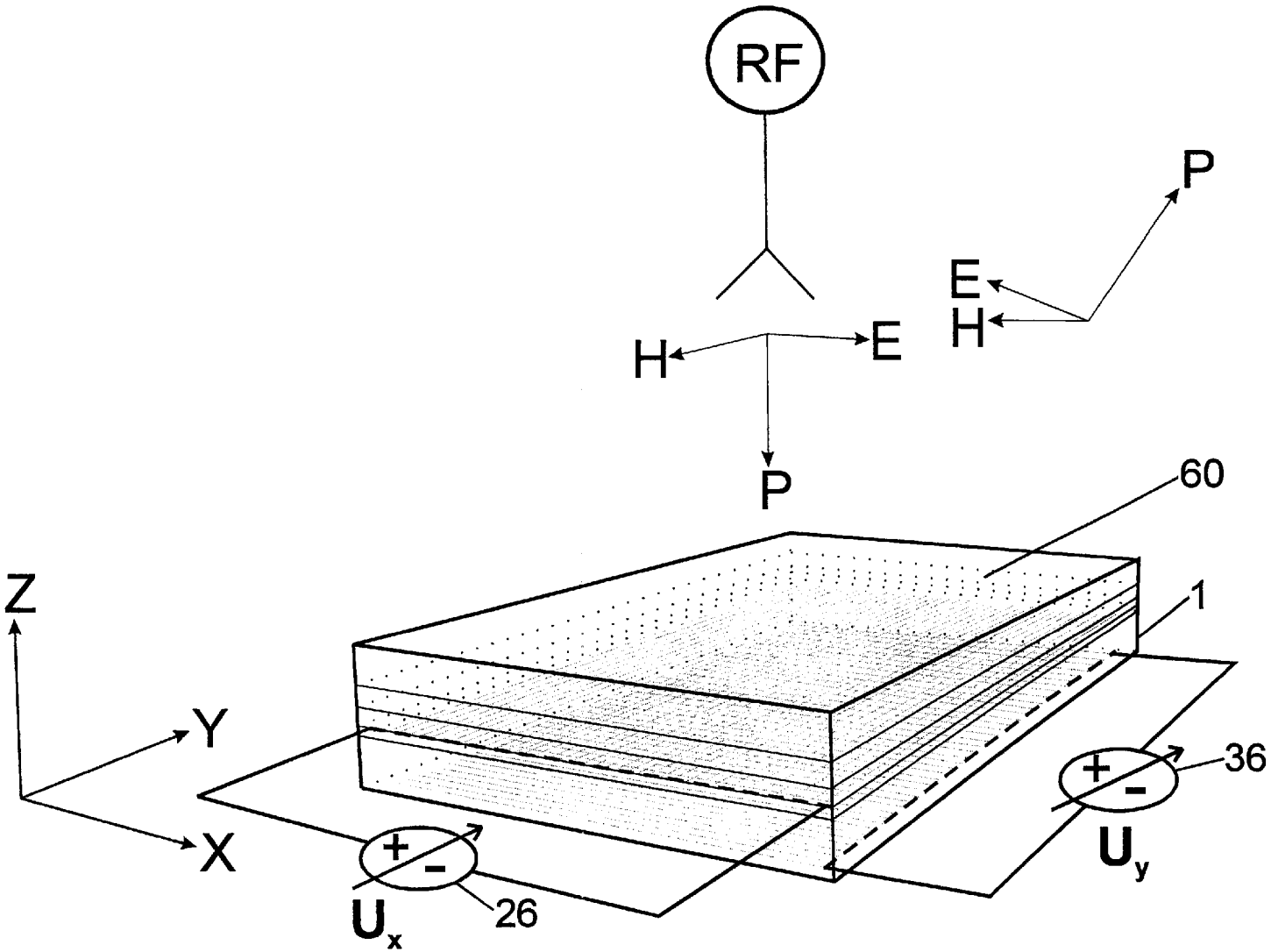
FIG. 4 illustrates a reflector element according to FIG. 3.

In FIG. 4 is demonstrated similar to FIG. 2 how the lobe of the continuous aperture scanning reflector antenna will be controlled in the X-Z plane by means of the voltage $U_x$ and in the Y-Z plane by means of the voltage $U_y$.

Figure 5:
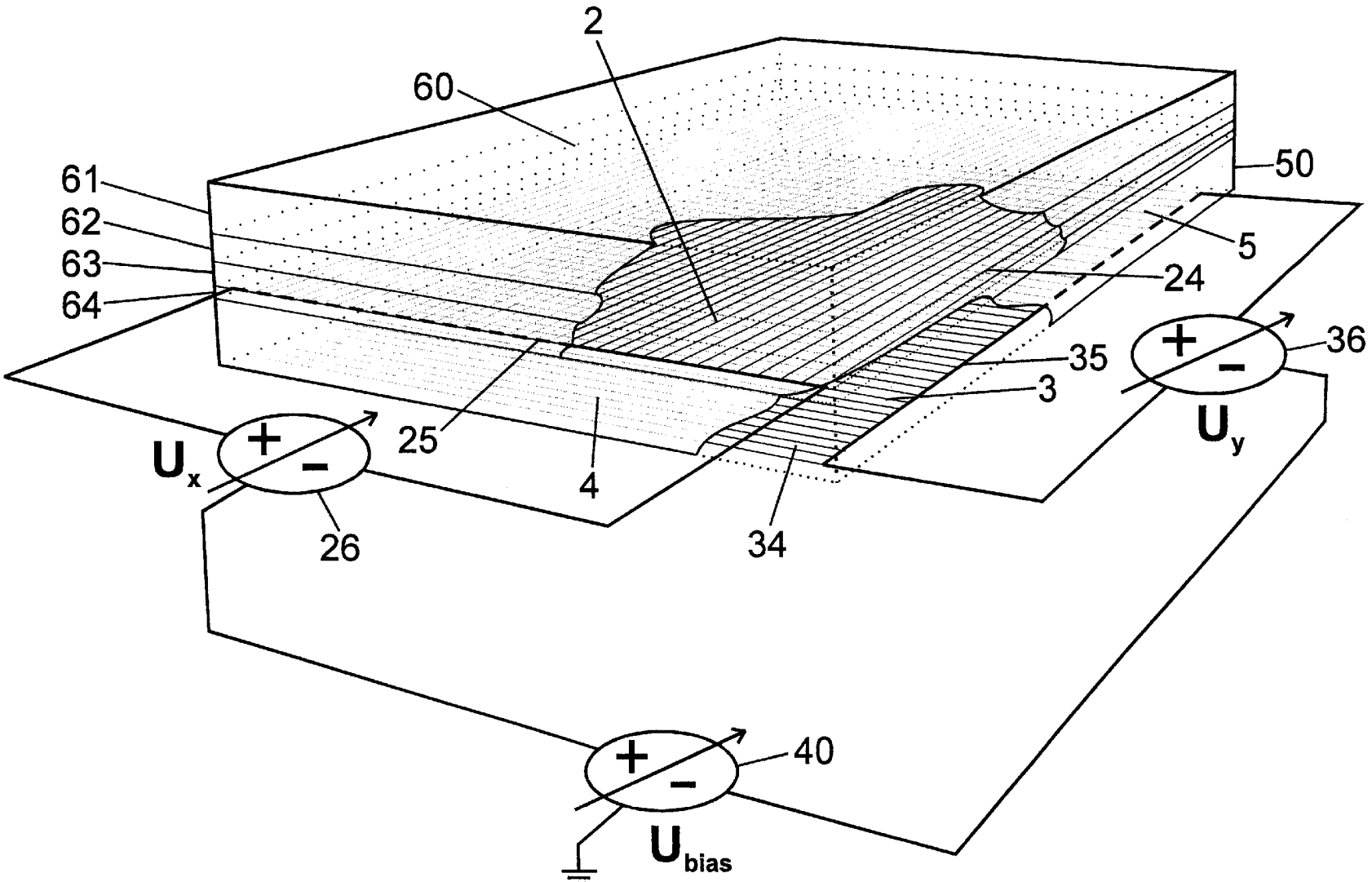
FIG. 5 is a more detailed illustration of a second embodiment of the present invention.

In order to obtain low losses and no change of E field polarity a bias source 40 ($U_{bias}$) of the order 5 to 10 kV is applied between the two voltage sources 26 and 36 for $U_x$ and $U_y$ for instance as demonstrated in FIG. 2 and FIG. 5. The symbols shown simply indicate that the bias is connected within the voltage range of the variable sources, preferably at a center point. In a similar manner it is indicated by the grounding at the symbol of the bias source how the device is referenced to a system ground. To achieve an impedance matching to the surroundings, it will in most of the cases be necessary to cover the surface of the reflector element with a transformer. The transformer will, step by step or continuously, change the impedance level such that the reflection of the surrounding medium (e.g. air) within the operative frequency range becomes low enough. It is also possible to have a step by step or continuous change of impedance entering into the ferroelectric material.

In FIG. 5 is more detailed demonstrated an embodiment of a reflector element according to the present invention. A typical desired frequency range for an antenna including the reflector element according to the present invention may be of the order 30–40 GHz. Here the reflector element comprises a flat slice 50 of the material presenting the ferroelectric properties. However, in another embodiment the reflector element may be designed to be for instance, a curved main reflector element to create a scanning aperture. The ferroelectric material may even constitute a reflector element of a polarization twisting Cassegrain antenna.

In an illustrative embodiment the material presenting the ferroelectric properties may be in the form of a flat square slice 50 having measures of about 10×10 cm and a thickness of about 0.5 cm. For instance, typical such materials are barium titanate, barium strontium titanate or lead titanate in fine grained random polycrystalline or ceramic form. A suitable ceramic, for instance made available on the market by Paratek Inc., Aberdeen, Md., USA, is for instance a material identified as Composition 4, which presents a relative dielectric constant $\in_r$ ($E_{DC}=0$)=118 and with a tunability of 10% according to the specification.

Figure 6:
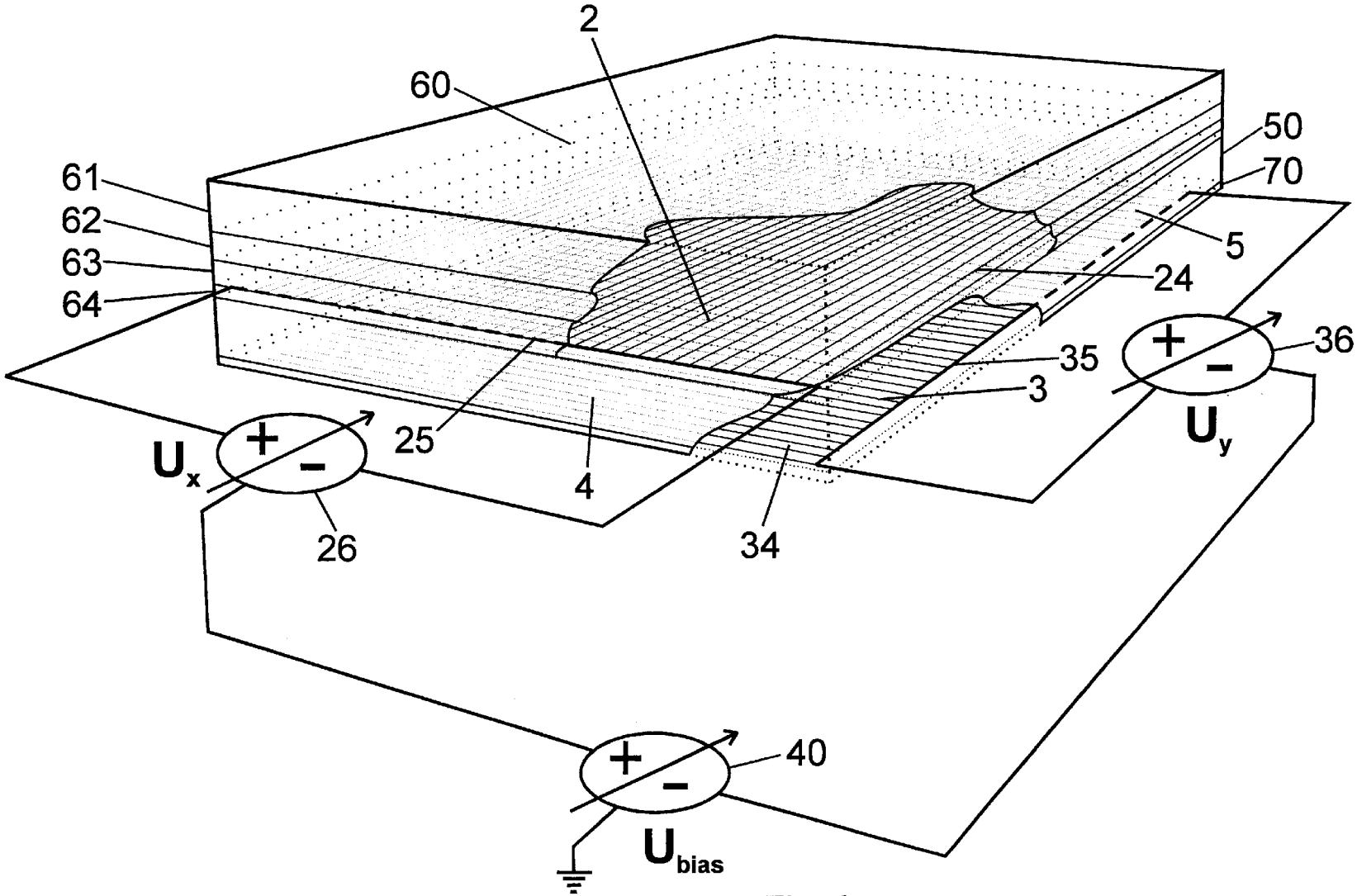
FIG. 6 illustrates a third embodiment of the present invention similar to the second embodiment of FIG. 5, but with a further dielectric layer added at the lower side of the ferroelectric plate.

In FIG. 6 is a more detailed embodiment of the reflector element is demonstrated. The lower side of the slice 50 is provided with a set of parallel conducting wires 34 connected together at one side by means of the resistive wire 35 running parallel to an edge 5 of the slice 50. Similarly there is at the upper side of the slice 50 arranged another set containing parallel conducting wires 24 positioned perpendicular to the set of wires 34. The set of wires 24 are also connected together by means of a resistive wire 25 parallel to another edge 4 of the slice 50, this edge 4 running perpendicular to the edge 5. In the embodiment according to FIG. 5 the wires 24 and 34 constitute highly conductive metal wires.

Across the resistive wire 35 is connected a variable voltage source 36 ($U_y$) and across the resistive wire 25 is connected another variable voltage source 26 ($U_x$). The variable voltage sources 26 and 36 in this illustrative embodiment can apply a voltage of the order −700 to +700 volts across the resistive wire 25 and resistive wire 35, respectively. The resistive wires 25 and 35 present a resistance each of the order $5\times10^8$ ohms for distributing an electric field generated by the voltage applied across the respective grids of highly conducting wires. Consequently, the voltage source 36 will provide the scanning in the Y direction, while the voltage source 26 will provide the scanning in the X direction.

Furthermore, on top of the slice 50 of the reflector element there is arranged an impedance transformer 60 to obtain an impedance matching for the present reflector element, which may represent an impedance value of the order of 40 ohms. The impedance transformer in the illustrative embodiment consists of a number of layers 61, 62, 63 and 64 of dielectric material presenting a stepwise change of the dielectric constant for a stepwise matching the impedance of the reflector element to the surroundings (e.g. free air≈377 ohms).

It should be noted that in the first embodiment of the present reflector element according to the present invention illustrated in FIG. 1 and FIG. 2 has three grids. One reflector grid of highly conducting wires at the lower side of the ferroelectric material and additionally two grids of resistive wires at each side of the ferroelectric slice and perpendicular to each other.

Description of Lobe Control

If $U_x=U_y=0$ the antenna lobe will coincide with the surface normal surface in the simple case of a flat mirror surface element being illuminated by an incident field perpendicular to the flat surface element. When for instance $U_x$ and $U_y$ are changed to $U_{xo}$ and $U_{yo}$, respectively, it will be created a static electric field over the material presenting the ferroelectric properties in accordance to:

$$E(x,y)=(U_{xo}\cdot x/x_a-U_{yo}\cdot y/y_a+U_{bias})/d \quad (1)$$

d then representing the thickness of the material presenting the ferroelectric properties, $y_a$ representing the extension of the plate in the Y direction of the aperture and $x_a$ representing its extension in the X direction. If $\in$ lies within a range being approximately linear as a function of E the dielectric constant (permittivity) will vary over the surface according to:

$$\in(x,y)=\in(U_{bias})-C\cdot E(x,y) \quad (2)$$

This results in a phase gradient over the surface for the reflected wave according to:

$$\Delta\psi(x,y)=(4\pi d/\lambda_o)\cdot\sqrt{\in(x,y)} \quad (3)$$

The lobe will approximately point to the direction of the surface normal of the phase gradient in the middle of the aperture (x=y=0). The angle $\Phi_x$ between the axis Z and the projection of the lobe onto the plane X-Z will approximately become $$\Phi_x=a\tan(d/dx(\Delta\psi(x,y))|_{x=y=0}\cdot(\lambda_0/(2\pi))) \quad (4)$$

The $\in_o$ represents the dielectric constant of the surrounding medium (normally air). In an analogue way the angle $\Phi_y$ between the axis Z and the projection of the lobe onto the plane X-Y becomes approximately:

$$\Phi_y=a\tan(d/dy(\Delta\psi(x,y))|_{x=y=0}\cdot(\lambda_0/(2\pi))) \quad (5)$$

Consequently a full lobe control will simply be obtained in both of the planes X-Z and X-Y. A change of lobe direction is instantaneously obtained with a change of the applied electric voltages onto the two resistive wires connected to a respective grid of highly conductive wires or to a respective grid of resistive wires.

Thus, another advantage of the present invention, which utilizes a reflector element design in relation to the normal applications, which are utilizing a transmissive lens of ferroelectric material, is that the phase-shifting action of the ferroelectric plate can be utilized in a double way.

There is additionally a possibility to coat the side underneath the plate 50 with a material having a value of $\in$ not being affected by the applied electric field to avoid that different portions of the reflector element reflect the lobe in different directions. In this way the reflection takes place at the same impedance level over the entire surface. FIG. 6 demonstrates such an embodiment similar to the embodiment of FIG. 5 but which presents the additional layer 70 of a material having a value of $\in$ not affected by the electric fields generated by the first and second grids of wires.

It will be understood by those skilled in the art that various modifications and changes may be made to the present invention without departure from the scope thereof, which is defined by the appended claims.

What is claimed is:

1. A method for obtaining a continuous aperture scanning reflector antenna comprising the steps of:

arranging a reflector element in the form of a plate of a material presenting ferroelectric properties;

arranging a first grid of resistive wires onto a first side of the plate of material presenting ferroelectric properties, the wires of said first grid being connected in parallel by a first and a second highly conducting wire, each being electrically connected at respective ends of said resistive wires along said first and second highly conducting wire;

arranging a second grid of resistive wires onto a second side of the plate of material presenting ferroelectric properties, said second grid of wires running perpendicular to said first grid of wires and the wires of said second grid being connected in parallel by a third and a fourth highly conducting wire, each being electrically connected at respective ends of the resistive wires along said third and fourth highly conducting wires;

connecting a first variable voltage source $U_y$ across said first grid of resistive wires and a second variable voltage source $U_x$ across said second grid of resistive wires for creating a controllable variable electric potential perpendicularly along the wires of each grid forming a static E-field across said plate;

providing the plate on said second side with a layer of highly conducting wires forming a third grid of wires, said third grid of wires running parallel to said second grid of resistive wires;

illuminating the first side of the plate of material presenting ferroelectric properties with a linearly polarized microwave field, the E vector of which being parallel with said third grid of highly conducting wires;

controlling the dielectric constant across the surface of the reflecting element by controlling the voltage of the first and the second voltage sources to thereby control the direction of an antenna lobe generated by the reflected microwave power by means of the reflecting element of the scanning aperture antenna device.

2. The method according to claim 1, comprising the further step of arranging a biasing voltage $U_{bias}$ between said first and second grids of resistive wires, or said first and second voltage sources, to obtain low loss operation and to guarantee no change of the static E-field polarity.

3. The method according to claim 1, comprising the further step of arranging said first grid and said second grid of resistive wires such that the wires are parallel and equidistant within each grid.

4. The method according to claim 1, comprising the further step of arranging an impedance matching to the surroundings by covering the surface of the reflecting element with a transformation device, which, step by step or continuously, changes the impedance such that the coupling to the surroundings becomes sufficiently high within the operative frequency range of the antenna.

5. The method according to claim 1, comprising the further step of coating said plate underneath with a material having a value of $\in$ not being affected by the applied electric field to make certain that reflection takes place at a same impedance level over the entire lower surface of the plate.

6. A method for obtaining a continuous aperture scanning reflector antenna comprising the steps of:

arranging a reflector element in the form of a plate of a material presenting ferroelectric properties;

arranging a first grid of highly conducting wires onto a first side of the plate of material presenting ferroelectric properties;

arranging a second grid of highly conducting wires onto a second side of the plate of material presenting ferroelectric properties, said second grid highly conducting wires running perpendicular to said first grid of wires;

arranging a first resistive wire perpendicular to said first grid of highly conductive wires and electrically connected to one end of the highly conductive wires at points along said first resistive wire;

arranging a second resistive wire perpendicular to said second grid of highly conductive wires and electrically connected to one end of the highly conductive wires at points along said second wire;

connecting a first variable voltage source $U_x$ across said first resistive wire and a second variable voltage source $U_y$ across said second resistive wire to in this manner create a controllable varying electric potential along each one of said first and second resistive wires forming a static E-field across the plate between said first and second gird;

illuminating a first side of the plate of material presenting ferroelectric properties with a linearly polarized microwave field, the E vector of which being parallel with said second grid of highly conducting wires;

controlling the dielectric constant across the surface of the reflecting element by controlling the voltage of the first and the second voltage sources to thereby control the direction of an antenna lobe generated by microwave power reflected by means of the reflecting element of the scanning aperture antenna device.

7. The method according to claim 6, comprising the further step of arranging a biasing voltage ($U_{bias}$) between said first and second resistive wires, or said first and second voltage sources, to obtain low loss operation and to guarantee no change of the static E field polarity.

8. The method according to claim 6, comprising the further step of arranging said first and second grids of highly conducting wires having the highly conducting wires parallel and equidistant within each grid.

9. The method according to claim 6, comprising the further step of arranging an impedance matching to the surroundings by covering the surface of the reflecting element with a transformation device, which, step by step or continuously, changes the impedance such that the coupling to the surroundings becomes sufficiently high within the operative frequency range of the antenna.

10. The method according to claim 6, comprising the further step of coating said plate underneath with a material having a value of $\in$ not being affected by the applied electric field to make certain that reflection takes place at a same impedance level over the entire lower surface of the plate.

11. A continuous aperture scanning reflector antenna device comprising a reflector element in the form of a plate of a material presenting ferroelectric properties;

a first grid of resistive wires onto a first side of the plate of material presenting ferroelectric properties, the wires being connected in parallel by a first and a second highly conducting wire, each being electrically connected at respective ends of the resistive wires along said first and second highly conducting wires;

a second grid of resistive wires onto a second side of the plate of material presenting ferroelectric properties, said second grid of wires running perpendicular to said first grid of wires and the wires of said second grid being connected in parallel by a third and a fourth highly conducting wire, each being electrically connected at respective ends of the resistive wires of said second grid along said third and fourth highly conducting wires;

a third grid of highly conducting wires on the second side of the plate of material presenting ferroelectric properties, thereby forming a reflecting layer, said third grid of wires running parallel to said second grid of resistive wires;

a first variable voltage source $U_y$ connected across said first grid of resistive wires and a second variable voltage source $U_x$ connected across said second grid of resistive wires for creating a controllable varying electric potential along the wires of each grid forming a static E-field across said plate;

the first side of the plate of material presenting ferroelectric properties being illuminated with a linearly polarized microwave field having its E vector parallel with the grid of highly conducting wires, whereby the dielectric constant across the surface of the reflecting element is controlled by the voltage of the first and the second voltage sources to thereby control the direction of an antenna lobe of microwave power reflected by means of the reflecting element of the antenna device.

12. The device according to claim 11, wherein a biasing voltage $U_{bias}$ is arranged between the first and second grids of resistive wires, or said first and second voltage sources, to obtain low loss operation and to guarantee no change of the static E-field polarity.

13. The device according to claim 11, wherein the first and second grid of resistive wires are arranged such that the respective wires are parallel and equidistant within each grid.

14. The device according to claim 11, comprising an impedance matching to the surroundings in the form of a transformation device covering the surface, and which device, step by step or continuously, changes the impedance level such that the coupling to the surroundings becomes sufficiently high within the operative frequency range of the antenna.

15. The method according to claim 11, comprising the further step of coating said plate underneath with a material having a value of $\in$ not being affected by the applied electric field to make certain that reflection takes place at a same impedance leven over the entire lower surfact of the plate.

16. The device according to claim 11, wherein the reflector element of ferroelectric material constitutes a polarization twisting Cassegrain antenna with a flat main reflector element.

17. A continuous aperture scanning reflector antenna device for a source of electromagnetic waves comprising a reflector element in the form of a plate of a material presenting ferroelectric properties;

a first grid of highly conducting wires onto a first side of the plate of material presenting ferroelectric properties;

a second grid of highly conducting wires onto a second side of the plate of material presenting ferroelectric properties facing the source of electromagnetic waves, the second grid of wires running perpendicular to the first grid of highly conducting wires; a first resistive wire perpendicular to the first grid of highly conductive wires and electrically connected to one end of the highly conductive wires;

a second resistive wire perpendicular to the second grid of highly conductive wires and electrically connected to one end of the highly conductive wires;

a first variable voltage source $U_x$ connected across said first resistive wire and a second variable voltage source $U_y$ connected across said second resistive wire for creating a controllable varying electric potential across each one of the first and second resistive wires forming a static E-field across said plate between said first and second grids;

the plate of material presenting ferroelectric properties being illuminated with a linearly polarized microwave field having its E vector parallel with the second grid of highly conducting wires, whereby the dielectric constant across the surface of the reflecting element is controlled by the voltage of the first and the second voltage sources to thereby control the direction of an antenna lobe generated by microwave power reflected by means of the reflecting element of ferroelectric material.

18. The device according to claim 17, wherein a biasing voltage $U_{bias}$ is arranged between the first and second resistive wires or said first and second variable voltage sources to obtain low loss operation and to guarantee no change of the static E-field polarity.

19. The device according to claim 17, wherein the first and second grids of highly conducting wires have the highly conducting wires parallel and equidistant within each grid.

20. The device according to claim 17, comprising an impedance matching to the surroundings in the form of a transformation device covering the surface, and which device, step by step or continuously, changes the impedance level such that the coupling to the surroundings becomes sufficiently high within the operative frequency range of the antenna.

21. The device according to claim 17, wherein the reflector element of ferroelectric material constitutes a polarization twisting Cassegrain antenna with a flat main reflector element.

* * * * *

UNITED STATES PATENT AND TRADEMARK OFFICE

CERTIFICATE OF CORRECTION

PATENT NO. : 6,313,804 B1
DATED : November 6, 2001
INVENTOR(S) : Kent Olof Falk

It is certified that error appears in the above-identified patent and that said Letters Patent is hereby corrected as shown below:

Column 2,
Lines 16-23, delete "A method according to the present invention is set forth by the attached independent claim 1 or independent claim 4 and by the dependent claims 2 to 3, and 5 to 8. Similarly a continuous aperture scanning antenna device according to the method of the present invention is set forth by the attached independent claims 9 and 12 and further embodiments are defined in the dependent claims 10 to 11, and 13 to 17."

Column 6,
Line 60, replace "plate underneath" with -- second side of said plate --
Line 63, replace "the entire lower surface of the" with -- said second side of said --

Column 7,
Line 51, replace "plate underneath" with -- second side of said plate --
Line 54, replace "the entire lower surface of the" with -- said second side of said --

Column 8,
Line 42, replace "method" with -- device --
Line 43, replace "plate underneath" with -- second side of said plate --
Line 46, replace "leven over the entire lower surfact of the" with -- level over said second side of said --

Signed and Sealed this

Twenty-fifth Day of June, 2002

*Attest:*

*Attesting Officer*

JAMES E. ROGAN
*Director of the United States Patent and Trademark Office*